United States Patent [19]

Anderson

[11] 4,069,439

[45] Jan. 17, 1978

[54] FLAT PANEL DISPLAY WITH BEAM INJECTION CLEANUP

[75] Inventor: Charles Hammond Anderson, Rocky Hill, N.J.

[73] Assignee: RCA Corporation, New York, N.Y.

[21] Appl. No.: 765,109

[22] Filed: Feb. 2, 1977

[51] Int. Cl.[2] ..... H01J 29/08; H01J 29/72; H01J 31/00

[52] U.S. Cl. ..... 313/422; 313/432; 315/366

[58] Field of Search ..... 313/422, 400, 432, 439

[56] References Cited

U.S. PATENT DOCUMENTS

| | | | |
|---|---|---|---|
| 4,028,582 | 6/1977 | Anderson et al. | 313/432 |
| 4,031,427 | 6/1977 | Stanley | 313/422 |

*Primary Examiner*—Robert Segal

*Attorney, Agent, or Firm*—E. M. Whitacre; D. S. Cohen

[57] ABSTRACT

An evacuated envelope includes spaced, substantially parallel front and back walls, and a plurality of spaced, parallel supports between the front and back walls and forming a plurality of channels. A gun structure at one end of the channels directs at least one beam of electrons along each channel. In each of the channels is at least one beam focusing guide which confines the electrons in the beams but allows the beam to be selectively deflected out of the guide toward a phosphor screen on the inner surface of the front wall. Each of the focusing guides includes spaced walls between which the electron beam passes. Between the gun structure and each of the focusing guides is a beam clean-up section. The beam clean-up section serves to remove from the beam those electrons whose position and velocity vector are such that they would impinge on a wall of its focusing guide during the travel of the electron along the guide.

16 Claims, 6 Drawing Figures

FLAT PANEL DISPLAY WITH BEAM INJECTION CLEANUP

BACKGROUND OF THE INVENTION

The present invention relates to a flat panel display of the type which includes focusing guides for maintaining electrons which are injected thereinto in confined beams, and particularly to focusing guides which includes means for extracting widely divergent electrons from said beams at the injection ends of their respective guides.

There has been developed a flat panel display which includes an evacuated envelope having a substantially rectangular display section and a gun section extending along at least one edge of the display section. The display section includes opposed front and back walls and spaced, parallel support walls extending between the front and back walls. The support walls are arranged to form therebetween channels which open at one end into a gun section. A phosphor screen extends across the inner surface of the front wall. The gun section contains a gun structure which is adapted to generate electrons and direct the electrons as beams along each of the channels. There is at least one beam for each channel. Along the channels are focusing guides through which the electron beams flow. There is one focusing guide for each electron beam. The focusing guides serve to confine the electrons in the beam along the entire length of the channel. The focusing guides also include means for deflecting the beams out of the guide toward the phosphor screen at spaced points along the length of the channels so as to achieve line-by-line scan of the phosphor screen. Such a display is described in the application for U.S. Pat. of T. O. Stanley, Ser. No. 670,492, filed Aug. 25, 1975, entitled "Flat Electron Beam Addressed Device".

There are several types of focusing guides which can be used in the above flat panel display. One type of focusing guide is described in the application for U.S. Pat. of T. L. Credelle, Ser. No. 607,490, filed Aug. 25, 1975, entitled "Flat Display Device With Beam Guide" hereinafter described in detail.

Another type of focusing guide is described in the application for U.S. Pat. of W. W. Siekanowicz et al., Ser. No. 671,358, filed Mar. 29, 1976, entitled "Flat Display Device With Beam Guide" hereinafter described in detail.

No matter what type of focusing guide is used, it is desirable to have all of the electrons injected into the guide travel the length of the guide without hitting any of the parts of the guide. This will provide the highest uniformity of brightness at each point of extraction along the guide. Although it may be possible to have a gun structure of such precision that it will inject all of the electrons into the guide in such a manner as to cause all electrons to so travel along the guide, such a gun would be difficult and expensive to make. Therefore, it would be desirable to be able to achieve this result in some other manner which is simpler and less expensive.

SUMMARY OF THE INVENTION

A display device includes a focusing guide having walls which serve to confine therebetween a beam of electrons injected thereinto by beam generating means. Between the electron beam generating means and each focusing guide is an electron beam clean-up means for removing from the generated beam the electrons which are so positioned and have such a velocity vector that the electrons would impinge on a wall of the focusing guide during the electrons travel along the focusing guide.

DETAILED DESCRIPTION

Figure 1:
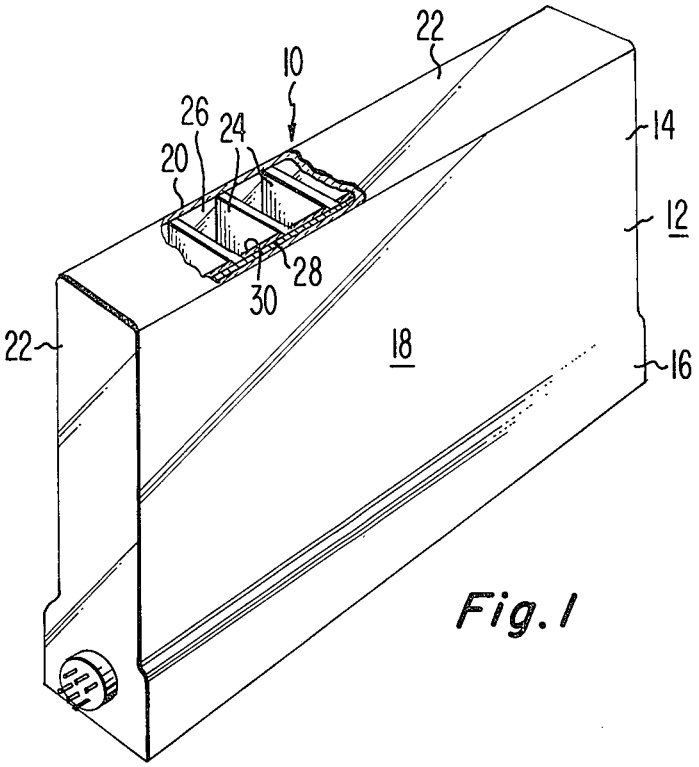
FIG. 1 is a perspective view, partially broken away, of a form of a flat panel display device in which the present invention can be used.

Referring to FIG. 1, one form of a flat display device which can utilize the injection beam clean-up of the present invention is generally designated as 10. The display device 10 comprises an evacuated envelope 12, typically of glass, having a display section 14 and an electron gun section 16. The display section 14 includes a rectangular front wall 18 which supports the viewing screen and a rectangular back wall 20 in spaced, parallel relation with the front wall 18. The front wall 18 and back wall 20 are connected by side walls 22. The front wall 18 and back wall 20 are dimensioned to provide the size of the viewing screen desired, e.g. 75 × 100 cm, and are spaced apart about 2.5 to 7.5 cm.

A plurality of spaced, parallel support walls 24 are secured between the front wall 18 and back wall 20 and extend from the gun section 16 to the opposite side wall 22. The support walls 24 provide the desired internal support for the evacuated envelope 12 against external atmospheric pressure and divide the display section 14 into a plurality of channels 26. On the inner surface of the front wall 18 is a phosphor screen 28. The phosphor screen 28 may be of any well known type presently being used in cathode ray tubes, e.g. black and white or color television display tubes. A metal film electrode 30 is provided on the phosphor screen 28.

The gun section 16 is an extension of the display section 14 and extends along one set of adjacent ends of the channels 26. The gun section may be of any shape suitable to enclose the particular gun structure contained therein. The electron gun structure contained in the gun section 16 may be of well known construction suitable for selectively directing beams of electrons along each of the channels 26. For example, the gun structure may comprise a plurality of individual gun mounted at the ends of the channels 26 for directing separate beams of electrons along the channels. Alternatively, the gun structure may include a line cathode extending along the gun section 16 across the ends of the channels 26 and adapted to electrically direct individual beams of electrons along the channels. A gun structure of the line type is described in U.S. Pat. No. 2,858,464 to W. L. Roberts, issued Oct. 28, 1958, entitled "Cathode Ray Tube".

In each of the channels 26 are focusing guides for confining electrons directed into the channel into a beam, which travels a path along the channel. Each guide also includes means for deflecting its beam out of the guide and toward the phosphor screen 28 at various points along the length of the channel 26. The focusing guides generally include a pair of walls extending transversely across and longitudinally along the channels 26 with one of the walls being at or adjacent to the back wall 20 and the other wall of the focusing guide being spaced from the one wall on the side toward the phosphor screen 28. The electrons forming the beams are generally injected into the guide between the guide walls. As previously stated, it is desirable that all of the electrons injected into the guide travel the full length of the guide to the point along the guide that the beam is deflected out of the guide. However, generally, some of the electrons injected into the guide are at a position with respect to the guide walls and have a velocity vector such that these particular electrons will hit one of the walls as they move the guide, either because of the initial position or velocity vector of the injected electron, or because of perturbations in the path of the electrons caused by construction errors in the guide. To eliminate such undesirable electrons, the present invention provides an injection beam clean-up section between the gun structure and the adjacent end of the focusing guide. The purpose of the injection clean-up section is to remove such undesirable electrons and allow to pass from the gun structure to the focusing guide substantially only those electrons which are positioned and which have a velocity vector such that the electrons will flow along the focusing guide under the focusing influence of the guide and in the presence of perturbations caused by construction errors in the guide without hitting the walls of the guide.

Figure 2:
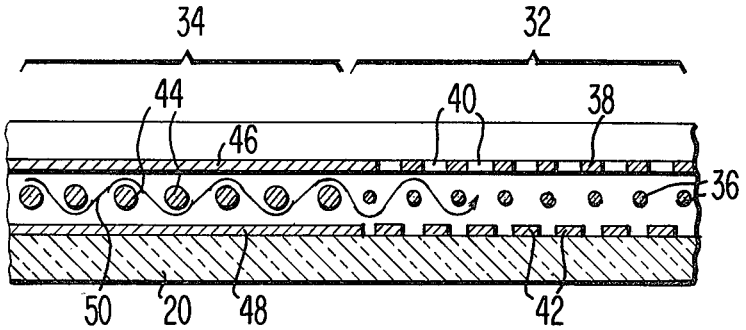
FIG. 2 is a sectional view of a portion of one type of focusing guide which includes the electron beam clean-up of the present invention.

Referring to FIG. 2 there is shown one form of a focusing guide, generally designated as 32, which can be used in the channels 26, and a beam clean-up section, generally designated as 34, between the end of the focusing guide 32 and the gun structure (not shown). The focusing guide 32 is of the type shown and described in the previously referred to application for U.S. Pat. of T. L. Credelle, Ser. No. 607,490. The focusing guide 32 includes a plurality of spaced, parallel wires 36 extending transversely across the channels 26. The wires 36 are in a common plane which is spaced from and parallel to the back wall 20 of the envelope 12. A metal ground plane electrode 38 extends transversely across the channels 26 spaced from and parallel to the wires 36 and between the wires 36 and the front wall 18 of the envelope 12. The ground plane electrode 38 as a plurality of openings 40 therethrough which are arranged in rows longitudinally along and transversely across the channel 26. The transverse rows of the openings 40 are positioned between adjacent wires 36. A plurality of spaced, parallel conductors 42 are on the inner surface of the back wall 20 of the envelope 12 and extend transversely across the channels 26. Each of the conductors 42 is aligned with and disposed opposite one of the openings 40 in the ground plane plate 38. As will be described, one purpose of the conductors 42 is as a second ground plate electrode.

The clean-up section 34 includes a plurality of spaced, parallel wires 44 extending transversely across the channel 26. The centers of the wires 44 are in the same common plane as that of the wires 36 of the focusing guide 32. A ground plane plate electrode 46 extends transversely across the channels 26 spaced from and parallel to the wires 44. The ground plane plate electrode 46 is coplanar with the ground plane plate electrode 38 of the focusing guide 32, and, as shown, is an extension of the focusing guide ground plane plate electrode. A metal conductor 48 is on the inner surface of the back wall 20 of the envelope 12 and extends across the channels 26 along the clean-up section 34. The metal conductor 48 serves as a ground plane electrode. The wires 44 have a center to center spacing equal to the spacing between the wires 36 of the focusing guide 32, but the clean-up section wires 44 are larger in diameter than the focusing guide wires 36.

In the operation of the display device 10 a potential is applied to each of the focusing guide wires 36 and each of the clean-up section wires 44 which is positive with respect to the potential applied to each of the focusing guide ground plane plate electrode 38, focusing guide conductors 42, clean-up section ground plate electrode 46 and clean-up section conductor 48. Electron beams are directed into the beam injection clean-up section 34 between the ground plane plate electrode 46 and the metal conductor 48, with each beam being directed along a path corresponding to a separate longitudinal row of the openings 40 in the focusing guide ground plane plate electrode 38. As described in the Credelle application Ser. No. 607,490, the potential difference between the focusing guide wires 36 and their related ground plane plate electrode 38 and conductors 42 creates electrostatic fields which will cause each of the electron beams to follow an undulating path 50 along the array of focusing guide wires 36 as shown. Similar potentials applied to the clean-up wires 44 and their related ground plane 46 and metal conductor 48 produce a similar undulation of the beam through the array of clean-up wires 44 as shown by the beam path 50.

The potentials applied to the focusing guide wires 36 and the clean-up section wires 44 create approximately circular equal potential lines around each of the wires with the potential at each of the equal potential lines decreasing radially outwardly from the center of the wires. The potential which is applied to each of the clean-up wires 44 is made equal to the potential which exists around each of the focusing guide wires 36 at a radius equal to the radius of the clean-up wires. Thus, the electrostatic forces in the clean-up section 34 and the focusing guide 32 are nearly identical outside a radius about each wire corresponding to the radius of the clean-up section wires 44 so that the motion of electrons are essentially identical in both the clean-up section 34 and the focusing guide 32. However, since the clean-up wires 44 are larger in diameter than the focusing guide wires 36 the volume of phase spaced which can be occupied by electrons in stable trajectories in the clean-up section 34 is less than in the focusing guide 32.

Electrons which travel in stable trajectories in a periodic focusing structure, such as the focusing guide 32, exhibit a long wavelength periodicity in which at least at one point the electrons pass close to a minimal distance to one of the electrodes. A long wavelength period is the distance an electron travels from a particular position and angle relative to the longitudinal axis of the electron path of travel until it reaches substantially the same relative position and angle with regard to the axis. Any electrons which are injected into the clean-up section 34 at such a position and with such a velocity vector that the trajectory of the electron will bring it too close to one of the electrodes, i.e. the wires 44, the ground plate 46 or the conductor 48, will be carried off by the electrode. By having the clean-up section 34 long enough so that all of the electrons injected into the clean-up section will reach its minimum distance with respect to the electrodes, this length being at least one long wavelength period and for the type of clean-up section 34 being 6 to 10 wires, substantially all of the electrons which would come too close to the electrodes would be removed before the beam reaches the focusing guide 32. Thus all of the electrons which pass through the clean-up section 34 into the focusing guide 32 will travel along the entire length of the focusing guide 32 without coming too close to the ground plane plate 34 or the conductors 42, which are the side walls of the focusing guide 32, so as to hit such side walls even as a result of perturbations caused by structural errors in the guide. Thus, the beam clean-up section 34 removes or cleans up from the beam those electrons which are injected from the gun structure into the clean-up section at a position and with such a velocity vector that the electron would hit the side walls of the focusing guide 32.

Typical dimensions for a focusing guide 32 and a clean-up section 34 are as follows:

- diameter of guide wires 36 = 0.1 millimeters
- diameter of clean-up section wires 44 = 0.75 millimeters
- center-to-center spacing between wires = 3.12 millimeters
- spacing between ground plane plates = 1.50 millimeters.

Figure 3:
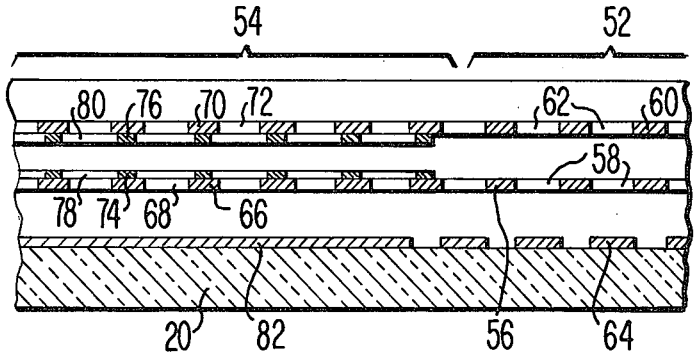
FIG. 3 is a sectional view of a portion of another type of focusing guide which includes an electron bean clean-up of the present invention.

Referring to FIg. 3, there is shown another type of focusing guide, generally designated as 52, which can be used in the channels 26, and a beam clean-up section 54 between the focusing guide 52 and the gun structure (not shown). The focusing guide 52 is of the type shown and described with regard to FIGS. 12–14 in the previously referred to application for U.S. patent of W. W. Seikanowicz et al., Ser. No. 671,358. The focusing guide 52 includes a first metal grid plate 56 which extends transversely across the channel 26 adjacent to but spaced from the back wall 20. The first grid plate 56 has a plurality of spaced, rectangular openings 58 therethrough. The openings 58 are arranged in rows both longitudinally along and transversely across the channel 26. The second metal grid plate 60 extends transversely across the channel 26 adjacent to but spaced from the first grid plate 56 on the side of the first grid plate 56 toward the front wall 18. The second grid plate 60 has a plurality of spaced, rectangular openings 62 therethrough. The openings 62 are arranged in rows both longitudinally along and transversely across the channel 26 with each of the openings 62 being opposite a different one of the openings 58 in the first grid plate 56. A plurality of spaced, parallel conductors 64 are disposed on the inner surface of the back wall 20 and extend transversely across the channel 26. The conductors 64 are strips of an electrically conductive material, such as a metal, coated on the back wall 20. Each of the conductors 60 lies directly opposite a transverse row of the openings 58 in the first grid plate 56.

The clean-up section 54 comprises a first grid plate 66 which is an extension of the first grid plate 56 of the focusing guide 52, and a second grid plate 70 which is an extension of the second grid plate 60 of the focusing guide 52. The first grid plate 66 and second grid plate 70 of the clean-up section 54 have openings 68 and 72, respectively, therethrough which correspond with the openings 58 and 62 in the grid plates of the focusing guide 52. First and second supplemental grid plates 74 and 76 are on the opposed surfaces of the first and second grid plates 66 and 70 respectively. The supplemental grid plates 74 and 76 have openings 78 and 80 respectively therethrough which are aligned with but are slightly larger than the openings 68 and 72 in the grid plates 66 and 70. A conductor 82 is disposed on the inner surface of the back wall 20 and extends along the full length of the clean-up section 54.

In the operation of the display device 10 having the focusing guide 52 and clean-up section 54 a relatively high positive potential, typically about 325 volts, is applied to each of the conductors 64 of the focusing guide 52 and the conductor 82 of the clean-up section 54. A low positive potential, typically about 40 volts is applied to each of the first and second grid plates 56 and 60 of the focusing guide 52 and the first and second grid plates 66 and 70 of the clean-up section 54.

The gun structure directs beams of electrons into the cleam-up section 54 between the first and second grid plates 66 and 70. A separate beam is directed along each longitudinal row of the grid plate openings. As described in application Ser. No. 671,358, the potential difference between the first and second grid plates 56 and 60 of the focusing guide 52 and conductors 64 and either the phosphor screen or other type of grid between the phosphor screen and the focusing guide creates electrostatic force fields which confines the electrons in the beam along the entire length of the path of the beams through the focusing guide 52. Since the clean-up section 54 is of substantially the same construction as the focusing guide, similar electrostatic force fields are created in the clean-up section to confine the electrons in the beam as the beam passes through the clean-up section 54. However, the supplemental grid plates 74 and 76 in the clean-up section 54 makes the transmitted volume of phase space in the cleanup section 54 smaller than in the focusing guide 52. Thus, in the clean-up section 54 the injected beam is stripped of its outer electrons to produce a smaller size beam. Also, any electrons which are injected into the clean-up section at a position and with such a velocity vector that the electron would hit the grid plates, will be removed from the beam in the clean-up section 54. To remove such electrons a long wavelength is preferred, which in practice means 6 to 8 periods of the clean-up section. Thus, when the beam leaves the clean-up section 54, there is clearance between the beam and the guide structure to allow for motion of the beam caused by imperfections in the guide so that the beam of electrons will then flow along the entire length of the focusing guide with little or no losses.

Typical dimensions for the focusing guide 52 and clean-up section 54 are as follows:

- Thickness of each of the grid plates = 0.15 millimeters
- Distance between grid plates in guide = 0.75 millimeters
- Distance between first grid plate and conductors = 0.50 millimeters
- Longitudinal length of each of openings in first and second grid plate = 0.9 millimeters
- Spacing between openings in first and second grid plates = 0.6 millimeters
- Spacing between openings in supplemental grid plates = approximately 0.2 millimeters.

Figure 4:
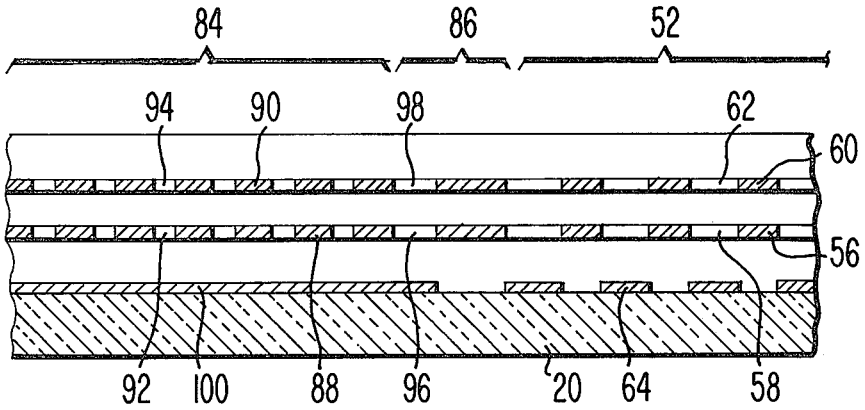
FIG. 4 is a section view of the type of focusing guide shown in FIG. 3 but which includes another form of the beam clean-up of the present invention.
Figure 5:
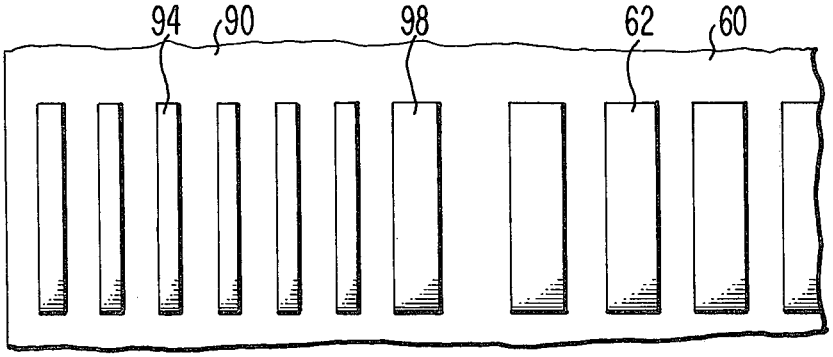
FIG. 5 is a top plane view of the guide plates of the focusing guide shown in FIG. 4.

Referring to FIGS. 4 and 5, there is shown the focusing guide 52 with another type of clean-up section, generally designated as 84. There is also provided a transition region 86 between the clean-up section 84 and the focusing guide 52. The clean-up section 84 and transition region 86 include first and second grid plates 88 and 90 which are extensions of the first and second grid plates 56 and 60, respectively of the focusing guide 52. In the clean-up section 84 the first and second grid plates 88 and 90 have a plurality of openings 92 and 94, respectively therethrough. The clean-up section openings 92 and 94 are in longitudinal alignment with the focusing guide openings 58 and 62. The size and spacing of the clean-up section openings 92 and 94 are such that in operation they create forces which will confine only those electrons whose velocity vector has a transverse component within a limited range, about one-half of that of the electrons which will pass freely through the focusing guide. As shown, one way of achieving this is to dimension the clean-up section openings 92 and 94 with a dimension longitudinally of the channel smaller than the corresponding dimension of the focusing guide openings 58 and 62 with the longitudinal spacing between the clean-up section openings in each grid plate being greater than the longitudinal spacing between the openings in the focusing guide. In the transition region 86 each of the grid plates 88 and 90 has an opening 96 and 98, respectively therethrough which has a size and position to create forces which will reduce the beam diameter to a size smaller than the spacing between the grid plates of the focusing guide. As shown, this can be achieved by making each of the openings 96 and 98 with a longitudinal dimension greater than the longitudinal dimension of the openings 92 and 94 in the clean-up section 84 but smaller than the longitudinal dimension of the openings 58 and 62 in the focusing guide 52. Also, the spacing between each of the transition region openings 92 and 94 and its adjacent focusing guide opening 58 and 62 is greater than the spacing between the transition region openings 96 and 98 and the adjacent clean-up section openings 92 and 94. A conductor 100 is on the inner surface of the back wall 20 and extends along the clean-up section 84 and the transition region 86.

In the operation of the FIG. 4 modification of the display device 10 the focusing guide 52 is operated in the same manner as previously described with regard to the focusing guide shown in FIG. 3. Since the grid plate 88 and 90 of the clean-up section 84 and transition region 86 are extensions of the grid plates 56 and 60 of the focusing guide 52, the grid plates 88 and 90 have the same potential applied to them as to the grid plates 56 and 60. The same potential is applied to the conductor 100 as is applied to the conductors 64 of the focusing guide 52. The potential difference between the first and second grid plates 56 and 60 of the focusing guide 52 and the conductor 64 and either the phosphor screen or other type of grid between the phosphor screen and the focusing guide creates electrostatic force fields which confine the electrons in the beam along the entire length of the path of the beam through the focusing guide 52. Since the grid plates 88 and 90 of the clean-up section 84 and transition region 86 are at the same potential as the grid plates 56 and 60 of the focusing guide, similar electrostatic force fields are generated in the clean-up section 84 and the transition region 86. However, in the clean-up section 84, the size and spacing between the openings 92 in the first grid plate 88 and the openings 94 in the second grid plate 90 are such that the forces applied to the electrons allow the electrons which have a velocity vector with a transverse vector outside the limited range to hit the wall of the clean-up section, i.e. the grid plates 88 and 90, and be carried off by the grid plates. To achieve this, the clean-up section 84 should be a long wavelength long, which in practice is 12 to 16 holes long. In the focusing guide 52 the generated electrostatic fields apply forces which confine the electrons transmitted by the beam clean-up section in a beam smaller than the space between the grid plates 56 and 60. In the transition region 86 the openings 96 and 98 are of a size and so positioned that the electrostatic force field will compress the electrons from the clean-up section into a smaller beam in the focusing guide 52. Thus, electrons which are injected between the grid plates at a position and with a velocity vector such that the electrons would hit the side walls of the focusing guide are removed in the clean-up section 84 so that when the beam size is reduced in the focusing guide 52, the electrons will flow along the entire length of the focusing guide 52 without hitting the sides of the focusing guide.

Typical dimensions for a focusing guide 52 and clean-up section 84 which will achieve the above results are as follows:

- Distance between first and second grid plates = 0.75 millimeters
- Distance between first grid plate and back wall = 0.50 millimeters
- Longitudinal dimension of openings in focusing guide grid plates = 0.90 millimeters
- Spacing between openings in each of focusing guide grid plates = 0.60 millimeters
- Longitudinal dimension of openings in clean-up section grid plates = 0.40 millimeters
- Spacing between openings in each of the grid plates of the clean-up section = 0.65 millimeters
- Longitudinal dimension of openings in grid plates of transition region = 0.70 millimeters
- Spacing between transition regions openings and adjacent openings in clean-up section = 0.65 millimeters
- Spacing between transition regions openings and adjacent openings in focusing guide = 1.275 millimeters
- Potential applied to each of the grid plates = 40 volts
- Potential applied to each of the conductors on the back wall = 325 volts.

Figure 6:
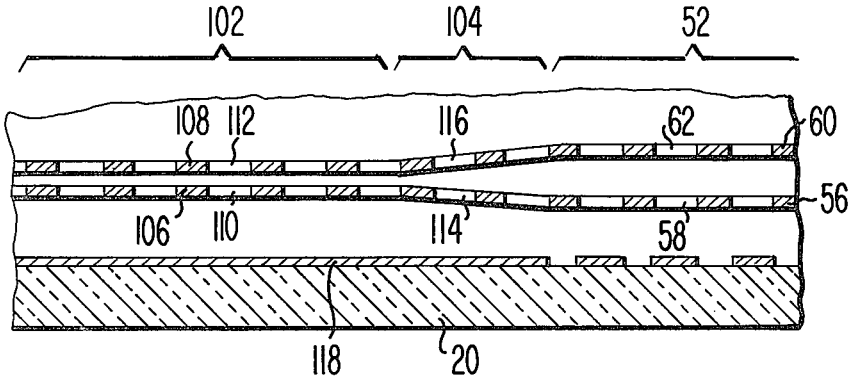
FIG. 6 is a sectional view of a portion of a focusing guide of the type shown in FIG. 3 which includes yet another type of beam clean-up of the present invention.

Referring to FIG. 6 there is shown the focusing guide 52 with still another type of clean-up section, generally designated as 102. There is also provided a transition region 104 between the clean-up section 102 and the focusing guide 52. The clean-up section 102 and transition region 104 include first and second grid plates 106 and 108 which are extensions of the first and second grid plates 56 and 60 respectively of the focusing guide 52. However, in the clean-up section 102 the spacing between the grid plates 106 and 108 is less than the spacing between the grid plates 56 and 60 of the focusing guide 52. In the transition region 104 the spacing between the grid plates 106 and 108 varies from that between the gird plates in the clean-up section to that between the grid plates in the focusing guide 52. In the clean-up section 102 the first and second grid plates 106 and 108 have a plurality of openings 110 and 112 respectively therethrough. The clean-up section openings 110 and 112 are in longitudinal alignment with the focusing guide openings 58 and 62. Also, the clean-up section openings 110 and 112 may be of the same size and spacing as the focusing guide openings 58 and 62. In the transition region 104 the grid plates 106 and 108 have openings 114 and 116 respectively therethrough which are in longitudinal alignment with the focusing guide openings 58 and 62 and the clean-up section openings 110 and 112. A conductor 118 is on the inner surface of the back wall 20 and extends along the clean-up section 102 and the transition region 104.

In the operation of the FIG. 6 modification of the display device 10 the focusing guide 52 is operated in the same manner as previously described to provide electrostatic force fields which confine electrons passing between the first and second grid plates 58 and 60 and an electron beam which is spaced from the grid plates. Since the grid plates 106 and 108 of the clean-up section 102 and transition region 104 are extensions of the grid plates 58 and 60 of the focusing guide 52, the grid plates 106 and 108 have the same potentials applied to them as to the grid plates 56 and 60 so as to generate similar electrostatic force fields in the clean-up region 102 and transition region 104. However, in the clean-up section 102 and grid plates 106 and 108 are spaced apart a distance such that the electron beams passing between the grid plates substantially fill the space between the grid plates. Thus, any electrons injected into the clean-up section 102 at a position and with a velocity vector such that the electrons would hit the walls of the focusing guide will hit the grid plates 106 or 108 and be carried away. In the transition region 104, the openings 114 and 116 are of a size and spacing so as to provide a smooth transition of the forces applied to the electrons as they pass from the force field in the clean-up section 102 to the force field in the focusing guide 52. In the focusing guide 52 the electrostatic force field is such as to maintain the beam of electrons at the same size as the beam was in the clean-up section 102. However, since the grid plates 56 and 60 of the focusing guide 52 are spaced apart a distance greater than the grid plates 106 and 108 of the clean-up section 102, the beam will be spaced from the walls of the focusing guide 52. Since any electrons which would hit the walls of the focusing guide 52 were removed in the clean-up section 102, the beam of electrons will pass along the entire length of the focusing guide 52 with a minimal loss of electrons.

Thus, there is provided by the present invention a focusing guide for a display device with a clean-up section between the focusing guide and the gun structure which generates the electrons and directs the electrons into the focusing guide. The clean-up section serves to remove electrons injected by the gun structure into the focusing guide at a position and with a velocity vector such that the electrons would hit the walls of the focusing guide. Thus, the electrons which enter the focusing guide from the clean-up section will travel the entire length of the focusing guide without hitting the walls of the focusing guide so as to provide a minimal loss of electrons along the length of the focusing guide. Thus, the magnitude of the electrons impinging on the phosphor screen of the display device will be substantially uniform along the entire length of the focusing guide so as to achieve a display of substantially uniform brightness.

I claim:

1. In a display device which includes an evacuated envelope having spaced front and back walls, at least one electron beam focusing guide extending substantially parallel to said front and back walls, said focusing guide having walls which serve to confine therebetween a beam of electrons directed into the focusing guide, and means for generating at least one beam of electrons and directing each beam into a separate focusing guide, the improvement comprising, electron beam clean-up means between said electron beam generating means and said focusing guide for removing from the generated beam the electrons which are so positioned and have such a velocity vector that if allowed to remain in said beam would impinge on a wall of the said focusing guide during the travel along the focusing guide.

2. A display device in accordance with claim 1 in which the electron beam clean-up means transmits a smaller volume of phase space than that of the focusing guide.

3. A display device in accordance with claim 2 in which the focusing guide includes a plurality of spaced, parallel wires extending transversely across the focusing guide in a common plane parallel to the front wall of the envelope, a separate ground plane electrode on opposite sides of and substantially parallel to the plane of the wires, and said clean-up means includes a plurality of spaced parallel wires parallel to and coplanar with said focusing guide wires, said separate ground plane electrode on each side of and substantially parallel to the plane of the beam clean-up wires, said beam clean-up wires being of a diameter larger than the diameter of the focusing guide wires.

4. A display device in accordance with claim 3 in which the center-to-center spacing of the beam clean-up wires is equal to the center-to-center spacing of the focusing guide wires.

5. A display device in accordance with claim 4 in which each of the ground plane electrodes of the beam clean-up means is in the same plane as a separate one of the ground plane electrodes of the focusing guide.

6. A display device in accordance with claim 5 in which one of the ground plane electrodes of the focusing guide and the beam clean-up means extends along the back wall of the envelope and the other ground plane electrode of the focusing guide and the beam clean-up means is between the wires and the front wall of the envelope and the other ground plane electrodes of the focusing guide has a plurality of openings therethrough.

7. A display device in accordance with claim 2 in which the focusing guide includes a pair of spaced, parallel grid plates adjacent to but spaced from the back wall of the envelope and parallel to the front wall of the envelope, said grid plates having a plurality of aligned openings therethrough arranged in at least one row longitudinally along the focusing guide and a plurality of conductors on the corner surface of the back wall of the envelope with each conductor extending across a separate pair of aligned openings in the grid plates, and the beam clean-up means includes a pair of spaced, parallel grid plates with the space between the grid plates being in alignment with the space between the focusing guide grid plates, the beam clean-up grid plates having aligned openings therethrough and a conductor on the inner surface of the back wall of the envelope and extending along the beam clean-up grid plates.

8. A display device in accordance with claim 7 in which the clean-up means includes a supplemental grid plate on the surface of each of the beam clean-up grid plates which form the other beam clean-up grid plate, each of said supplemental grid plates having openings therethrough corresponding to the openings in the beam clean-up grid plates.

9. A display device in accordance with claim 8 in which the beam clean-up grid plates are each extensions of a separate one of the focusing guide grid plates.

10. A display device in accordance with claim 7 in which the spacing between the beam clean-up grid plates is less than the spacing between the focusing guide grid plates.

11. A display device in accordance with claim 10 including a transition region between the beam clean-up grid plates and the focusing guide grid plates, said transition region adapted to provide a smooth transition of the focus applied to the electrons of the beam from the beam clean-up of the focusing guide and produce a small beam with clearance in the focusing guide.

12. A display device in accordance with claim 11 in which the transition region includes a pair of spaced grid plates having opposed openings therethrough, said transition grid plates varying in spacing between the spacing between the beam clean-up grid plates and the spacing between the focusing guide grid plates.

13. A display device in accordance with claim 12 in which each of the transition grid plates and beam clean-up grid plates is an extension of a separate one of the focusing guide grid plates.

14. A display device in accordance with claim 7 in which each of the beam clean-up grid plates is coplanar with a separate one of the focusing guide grid plates and the size and spacing of the openings in the beam clean-up grid plates are such as to create focusing forces which will confine only those electrons which have a velocity vector whose transverse component is within a limited range of less than that of the electrons in the guide.

15. A display device in accordance with claim 14 including a transition region between the beam clean-up and the focusing guide for providing forces applied to the electrons of the beam as the electrons pass from the beam clean-up to the focusing guide which will compress the beam to a smaller size.

16. A display device in accordance with claim 15 in which the beam clean-up grid plates are extensions of the focusing guide grid plates.

* * * * *